United States Patent [19]

Oza

[11] Patent Number: 4,797,263

[45] Date of Patent: Jan. 10, 1989

[54] MONOLITHIC CATALYTIC CONVERTER WITH IMPROVED GAS DISTRIBUTION

[75] Inventor: Rajshekhar D. Oza, Troy, Mich.

[73] Assignee: General Motors Corporation, Detroit, Mich.

[21] Appl. No.: 82,929

[22] Filed: Aug. 6, 1987

Related U.S. Application Data

[63] Continuation of Ser. No. 836,699, Mar. 6, 1986, abandoned.

[51] Int. Cl.[4] ..... F01N 3/24; B01D 53/36

[52] U.S. Cl. ..... 422/176; 422/177; 422/180; 422/222; 55/414; 55/416; 60/299

[58] Field of Search ..... 422/176, 177, 180, 222; 55/414, 416; 60/299

[56] References Cited

U.S. PATENT DOCUMENTS

| | | | |
|---|---|---|---|
| 3,695,851 | 10/1972 | Perga | 422/176 X |
| 3,719,457 | 3/1973 | Nagamatsu | 422/176 |
| 3,749,130 | 7/1973 | Howitt et al. | 422/176 X |
| 3,780,772 | 12/1973 | Carnahan et al. | 422/177 X |
| 4,002,433 | 1/1977 | Oser | 422/176 |
| 4,328,188 | 5/1982 | Kawata | 422/176 X |

FOREIGN PATENT DOCUMENTS

| | | | |
|---|---|---|---|
| 0082516 | 5/1984 | Japan | 60/299 |

*Primary Examiner*—Barry S. Richman
*Assistant Examiner*—Lynn Kummert
*Attorney, Agent, or Firm*—R. L. Phillips

[57] ABSTRACT

A catalytic converter has a monolith with a plurality of catalyst coated passages to which internal combustion engine exhaust gases are directed with a nonuniform velocity profile that is highest at the center. A flow distributor is mounted in the converter downstream of the monolith that restricts flow centrally through the monolith while allowing relatively free flow radially outward toward the periphery to thereby alter the velocity profile at the entrance to the monolith so as to effect substantially equal distribution of the gases between all the monolith passages without extracting heat from the gases prior to entering same and without adding substantial back pressure.

2 Claims, 1 Drawing Sheet

MONOLITHIC CATALYTIC CONVERTER WITH IMPROVED GAS DISTRIBUTION

This is a continuation of application Ser. No. 836,699, filed on Mar. 6, 1986, now abandoned.

TECHNICAL FIELD

This invention relates to monolithic catalytic converters and more particularly to the exhaust gas flow therethrough.

BACKGROUND OF THE INVENTION

In catalytic converters having a monolith with a plurality of catalyst coated passages through which internal combustion engine exhaust gases are directed for treatment, the gas velocity in the converter's inlet snorkel is normally nonuniform thereacross. For example, the velocity profile typically resembles a parabolic curve with the velocity maximum at the center and decreasing significantly out toward the monolith periphery. As a result, the exhaust gases are unevenly distributed between the monolith passages and not all the catalyst is effectively utilized.

Various concepts have been proposed to improve flow distribution to the monolith passages and thus to the catalyst. Typically, these designs have attempted to alter the exhaust gas flow in the inlet snorkel before it reaches the upstream face of the monolith. The two most common types are diffusers and modified inlet snorkels. The diffusers are normally mounted upstream of the monolith and designed to create very turbulent flow within the snorkel for improved distribution. On the other hand, the modified or special inlet snorkel designs typically include large diameter inlet pipes, smaller diverging angles, dual pipes or some combination thereof. Both diffusion and snorkeling require the flow distribution to become uniform whether the entering flow is in laminar or turbulent form. This is particularly difficult to do with a diffuser. Moreover, an upstream diffuser extracts heat thereby increasing the catalyst warm-up time. Snorkels also add to the warm-up time as well as present an additional problem of space allocation since lessening the diverging angle to improve the flow distribution adds to the length of the snorkel and thus to the heat extraction prior to monolith entry.

SUMMARY OF THE INVENTION

The present invention operates to effect the desired uniform flow distribution to the monolith passages with a flow distributor that is located downstream of the monolith so as to not itself extract heat from the exhaust gases prior to entering the monolith. The flow distributor is preferably in the form of a plate that is located close to and spans the downstream face of the monolith. Apertures are formed in the plate at various locations and of different size and shape that cooperatively produce a centrally located, relatively small, restricted flow region and a radially outwardly located, relatively large, substantially unrestricted flow region. This causes the gas velocity peak at the center of the front face of the monolith to diminish while the velocity radially outward is caused to increase so as to produce a substantially uniform velocity profile and thereby substantially uniform distribution of the gas between all the monolith passages without adding substantial back pressure.

DETAILED DESCRIPTION OF PREFERRED EMBODIMENT

These and other objects, features and advantage of the invention will become more apparent from the following description and drawing in which.

Figure 1:
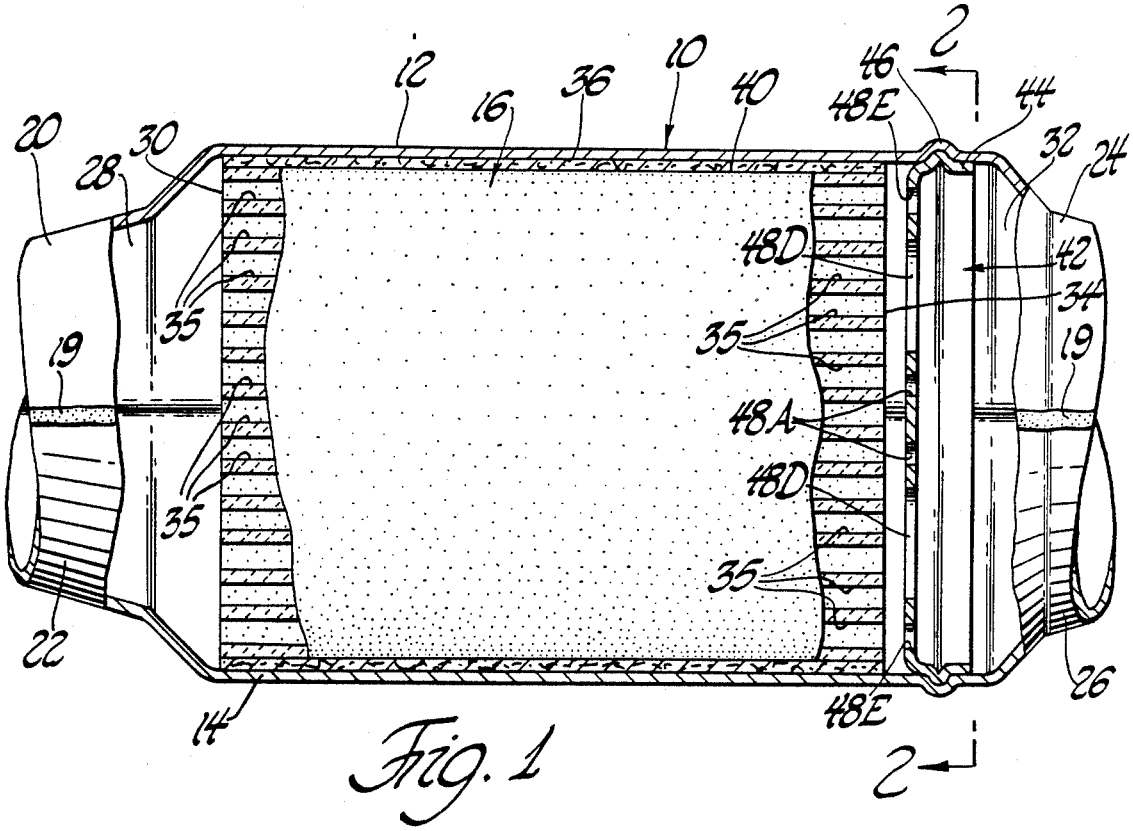
FIG. 1 is a side view with parts broken away of a monolithic catalytic converter having the preferred construction of the downstream located flow distributor according to the invention.

Referring to FIG. 1, there is shown a monolithic catalytic converter generally designated as 10 for treating internal combustion engine exhaust gases. The converter comprises a clam-shell type housing having an upper shell 12 and a lower shell 14 of stamped sheet metal which cooperatively enclose a monolith 16. The shells have abutting flanges 17 and 18 along opposite sides which are edge welded by a weld 19 and in addition have cooperating snorkel portions 20, 22 and 24, 26 of short length at opposite ends thereof which from a diverging inlet 28 to the upstream face 30 of the monolith and a converging outlet 32 from the downstream face 34 thereof. The monolith has catalyst coated cells or passages 35 extending therethrough from the front to the rear face and is supported in the housing by a sleeve 36 of intumescent material which immobilizes and resiliently supports the monolith as well as providing a seal about its periphery within the housing. The substrate of the monolith 16 may be formed of ceramic material or may be formed of coiled, stacked or folded metal foil.

Figure 2:
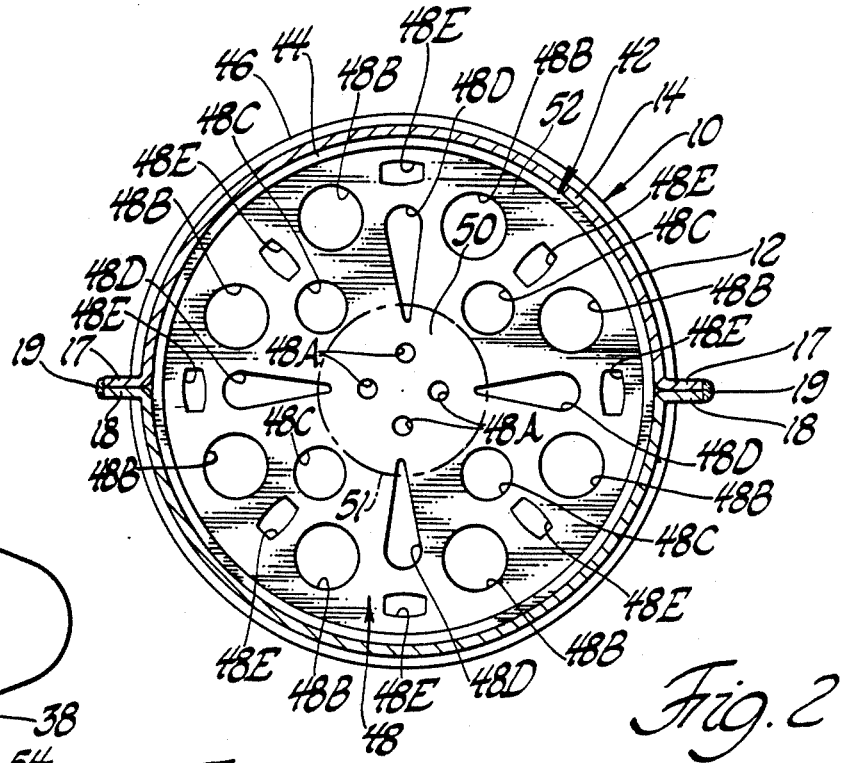
FIG. 2 is a view taken along the line 2—2 in FIG. 1.
Figure 3:
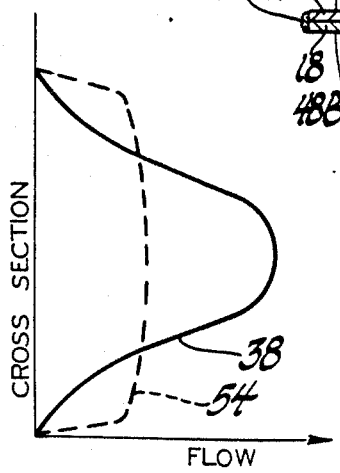
FIG. 3 is a graph showing the flow to and through the converter in FIG. 1.

The converter structure thus far described is conventional with the monolith typically having an oval cross-section for low profile purposes or less commonly a circular cross-section as shown in FIG. 2. In either case and without upstream diffusers or special inlet snorkels with a small diverging angle (e.g. less than about 4 degrees), the engine exhaust gases are directed to the front face of the monolith in a nonuniform cross-sectional flow profile as shown in FIG. 3 by the solid line 38. It is found that because of the maldistribution or nonuniform flow pattern, the exhaust gas flow is mainly through the center of the monolith with the distribution falling in significant amounts outwardly in the direction of the monolith periphery 40. As a result, in such prior art converters the catalyst is nonuniformly and therefore not fully or effectively utilized since those monolith cells or passages at the center receive the major portion of the exhaust gases to be treated while those near the periphery receive very little.

According to the present invention, a flow distributor plate 42 is mounted in the housing close to (e.g. within 1" of) the downstream or rear face 34 of the monolith. The plate has a peripheral flange 44 by which it is secured in place by circumferentially crimping the housing thereto at 46. The plate has apertures 48 formed therein at various locations and of different size and shape, i.e., small round holes 48A, large round holes 48B, intermediate size round holes 48C, radially extending teardrop shape holes 48D, and barrel shaped holes 48E. The various apertures 48 are configured and arranged so that there results a centrally located, relatively small, dense flow blocking zone 50 defined as being within the circle 51 in FIG. 2 and a radially outwardly located, relatively large, relatively unblocked zone 52 outside this circle. By design and arrangement of the distributor apertures 48, the flow exiting from the monolith passages is selectively blocked in the central zone 50 while substantially more direct flow through the distributor plate is permitted in the larger outer zone 52 where greater flow is desired. Their net effect is a radial redistribution of the gas flow entering the monolith such that the velocity peak at the center of the front face of the monolith is diminished while the velocity outward thereof is caused to increase by an increasing amount out toward the monolith periphery resulting in a substantially uniform velocity profile at the face of the monolith shown by the dash-line curve 54 in FIG. 3. As a result, the exhaust gases entering the converter are substantially evenly distributed between all the monolith passages to best utilize all the catalyst and without increasing the warm-up time or adding substantial back pressure.

The above described preferred embodiment is illustrative of the invention which may be modified within the scope of the appended claims.

The embodiments of the invention in which an exclusive property or privilege is claimed are defined as follows:

1. A method of redistributing exhaust gases from an internal combustion engine comprising providing a catalytic converter consisting essentially of a housing, a catalyst coated monolith and a downstream deflector adjacent a downstream face of the monolith, passing exhaust gases through the monolith and downstream deflector and selectively blocking flow across the entire downstream race of said monolith to produce a centrally located, relatively small, restricted flow region and a radially outwardly located, relatively large substantially unrestricted flow region parallel to said central region, whereby a substantially uniform distribution of gases between the passages at their entrance to the monolith is achieved without increasing catalyst warm-up time or adding substantial back pressure.

2. A method of redistributing exhaust gases from an internal combustion engine comprising providing a catalytic converter consisting essentially of a housing, a catalyst coated monolith and downstream deflector adjacent a downstream face of the monolith, passing exhaust gases through the monolith and downstream deflector and selectively blocking flow across the entire downstream face of said monolith in progressively lesser amounts radially outward from the center thereof to produce a centrally located, relatively small, restricted flow region and a radially outwardly located, relatively large substantially unrestricted flow region parallel to said central region, whereby a substantially uniform distribution of gases between the passages at their entrance to the monolith is achieved without increasing catalyst warm-up time or adding substantial back pressure.

* * * * *